US009395075B2

(12) United States Patent
Simon et al.

(10) Patent No.: US 9,395,075 B2
(45) Date of Patent: Jul. 19, 2016

(54) LED BULB FOR INCANDESCENT BULB REPLACEMENT WITH INTERNAL HEAT DISSIPATING STRUCTURES

(71) Applicant: iLumisys, Inc., Troy, MI (US)

(72) Inventors: David L. Simon, Farmington Hills, MI (US); John Ivey, Farmington Hills, MI (US)

(73) Assignee: iLumisys, Inc., Troy, MI (US)

( * ) Notice: Subject to any disclaimer, the term of this patent is extended or adjusted under 35 U.S.C. 154(b) by 5 days.

(21) Appl. No.: 14/492,517

(22) Filed: Sep. 22, 2014

(65) Prior Publication Data

US 2015/0009690 A1 Jan. 8, 2015

Related U.S. Application Data

(63) Continuation of application No. 14/032,488, filed on Sep. 20, 2013, now Pat. No. 8,840,282, which is a continuation of application No. 13/071,985, filed on Mar. 25, 2011, now Pat. No. 8,540,401.

(60) Provisional application No. 61/317,871, filed on Mar. 26, 2010.

(51) Int. Cl.
*F21V 29/00* (2015.01)
*F21K 99/00* (2016.01)
(Continued)

(52) U.S. Cl.
CPC . *F21V 29/22* (2013.01); *F21K 9/13* (2013.01); *F21K 9/135* (2013.01); *F21K 9/52* (2013.01); *F21V 21/00* (2013.01); *F21V 23/009* (2013.01); *F21V 23/06* (2013.01); *F21V 29/004* (2013.01); *F21V 29/508* (2015.01); *F21V 29/70* (2015.01); *F21V 29/74* (2015.01); *F21V 29/83* (2015.01);
(Continued)

(58) Field of Classification Search
None
See application file for complete search history.

(56) References Cited

U.S. PATENT DOCUMENTS

D79,814 S 11/1929 Hoch
D80,419 S 1/1930 Kramer
(Continued)

FOREIGN PATENT DOCUMENTS

CN 1584388 A 2/2005
CN 2766345 Y 3/2006
(Continued)

OTHER PUBLICATIONS

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.
(Continued)

*Primary Examiner* — Britt D Hanley
(74) *Attorney, Agent, or Firm* — Fish & Richardson P.C.

(57) ABSTRACT

An LED based light for replacing an incandescent bulb comprises a base having a first end and a second end; a connector fixed to the first end of the base, the connector adapted to physically connect to an incandescent light fixture; an open-ended light structure extending from the second end of the base, the light structure having an inner surface defining a cavity in fluid communication with an ambient environment and an opposing exterior outer surface; at least one LED arranged outward from the inner surface; and a heat dissipating structure for the at least one LED extending into the cavity.

19 Claims, 3 Drawing Sheets

(51) Int. Cl.

| | |
|---|---|
| ***F21V 23/00*** | (2015.01) |
| ***F21V 21/00*** | (2006.01) |
| ***F21V 23/06*** | (2006.01) |
| ***F21V 29/70*** | (2015.01) |
| ***F21V 29/74*** | (2015.01) |
| ***F21V 29/508*** | (2015.01) |
| ***F21V 29/83*** | (2015.01) |
| *F21Y 101/02* | (2006.01) |
| *F21V 29/15* | (2015.01) |
| *F21Y 105/00* | (2016.01) |

(52) U.S. Cl.

CPC ..... *F21V 29/15* (2015.01); *F21Y 2101/02* (2013.01); *F21Y 2105/001* (2013.01); *Y10T 29/49002* (2015.01)

(56) References Cited

U.S. PATENT DOCUMENTS

| | | | |
|---|---|---|---|
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenburg |
| 2,909,097 | A | 10/1959 | Alden et al. |
| 3,178,622 | A | 4/1965 | Paul et al |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | Mcleroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,587,459 | A | 5/1986 | Blake |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,650,971 | A | 3/1987 | Manecci et al. |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,847,536 | A | 7/1989 | Lowe et al. |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,920,459 | A | 4/1990 | Rothwell, Jr. et al. |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |

(56) References Cited

U.S. PATENT DOCUMENTS 5,027,037 A 6/1991 Wei
5,027,262 A 6/1991 Freed
5,032,960 A 7/1991 Katoh
5,034,807 A 7/1991 Von Kohorn
5,036,248 A 7/1991 McEwan et al.
5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,278,542 A 1/1994 Smith et al.
5,281,961 A 1/1994 Elwell
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,341,988 A 8/1994 Rein et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,781,108 A 7/1998 Jacob et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,841,177 A 11/1998 Komoto et al.
5,848,837 A 12/1998 Gustafson

(56) References Cited

U.S. PATENT DOCUMENTS 5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,904,415 A 5/1999 Robertson et al.
5,907,742 A 5/1999 Johnson et al.
5,909,378 A 6/1999 De Milleville
5,912,653 A 6/1999 Fitch
5,917,287 A 6/1999 Haederle et al.
5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,971,597 A 10/1999 Baldwin et al.
5,973,594 A 10/1999 Baldwin et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,107,755 A 8/2000 Katyl et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,220,722 B1 * 4/2001 Begemann ..... 362/231
6,227,679 B1 5/2001 Zhang et al.
6,238,075 B1 5/2001 Dealey, Jr. et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,290,140 B1 9/2001 Pesko et al.
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,388,396 B1 5/2002 Katyl et al.
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,522,078 B1 2/2003 Okamoto et al.
6,527,411 B1 3/2003 Sayers

(56) References Cited

U.S. PATENT DOCUMENTS

| | | | |
|---|---|---|---|
| 6,528,954 | B1 | 3/2003 | Lys et al. |
| 6,528,958 | B2 | 3/2003 | Hulshof et al. |
| 6,538,375 | B1 | 3/2003 | Duggal et al. |
| 6,540,381 | B1 | 4/2003 | Douglass, II |
| 6,541,800 | B2 | 4/2003 | Barnett et al. |
| 6,548,967 | B1 | 4/2003 | Dowling et al. |
| 6,568,834 | B1 | 5/2003 | Scianna |
| 6,573,536 | B1 | 6/2003 | Dry |
| 6,577,072 | B2 | 6/2003 | Saito et al. |
| 6,577,080 | B2 | 6/2003 | Lys et al. |
| 6,577,512 | B2 | 6/2003 | Tripathi et al. |
| 6,577,794 | B1 | 6/2003 | Currie et al. |
| 6,578,979 | B2 | 6/2003 | Truttmann-Battig |
| 6,582,103 | B1 | 6/2003 | Popovich et al. |
| 6,583,550 | B2 | 6/2003 | Iwasa et al. |
| 6,583,573 | B2 | 6/2003 | Bierman |
| D477,093 | S | 7/2003 | Moriyama et al. |
| 6,585,393 | B1 | 7/2003 | Brandes et al. |
| 6,586,890 | B2 | 7/2003 | Min et al. |
| 6,587,049 | B1 | 7/2003 | Thacker |
| 6,590,343 | B2 | 7/2003 | Pederson |
| 6,592,238 | B2 | 7/2003 | Cleaver et al. |
| 6,594,369 | B1 | 7/2003 | Une |
| 6,596,977 | B2 | 7/2003 | Muthu et al. |
| 6,598,996 | B1 | 7/2003 | Lodhie |
| 6,608,453 | B2 | 8/2003 | Morgan et al. |
| 6,608,614 | B1 | 8/2003 | Johnson |
| 6,609,804 | B2 | 8/2003 | Nolan et al. |
| 6,609,813 | B1 | 8/2003 | Showers et al. |
| 6,612,712 | B2 | 9/2003 | Nepil |
| 6,612,717 | B2 | 9/2003 | Yen |
| 6,612,729 | B1 | 9/2003 | Hoffman |
| 6,621,222 | B1 | 9/2003 | Hong |
| 6,623,151 | B2 | 9/2003 | Pederson |
| 6,624,597 | B2 | 9/2003 | Dowling et al. |
| D481,484 | S | 10/2003 | Cuevas et al. |
| 6,634,770 | B2 | 10/2003 | Cao |
| 6,634,779 | B2 | 10/2003 | Reed |
| 6,636,003 | B2 | 10/2003 | Rahm et al. |
| 6,639,349 | B1 | 10/2003 | Bahadur |
| 6,641,284 | B2 | 11/2003 | Stopa et al. |
| 6,652,117 | B2 | 11/2003 | Tsai |
| 6,659,622 | B2 | 12/2003 | Katogi et al. |
| 6,660,935 | B2 | 12/2003 | Southard et al. |
| 6,666,689 | B1 | 12/2003 | Savage, Jr. |
| 6,667,623 | B2 | 12/2003 | Bourgault et al. |
| 6,674,096 | B2 | 1/2004 | Sommers |
| 6,676,284 | B1 | 1/2004 | Wynne Willson |
| 6,679,621 | B2 | 1/2004 | West et al. |
| 6,681,154 | B2 | 1/2004 | Nierlich et al. |
| 6,682,205 | B2 | 1/2004 | Lin |
| 6,683,419 | B2 | 1/2004 | Kriparos |
| 6,700,136 | B2 | 3/2004 | Guida |
| 6,712,486 | B1 | 3/2004 | Popovich et al. |
| 6,717,376 | B2 | 4/2004 | Lys et al. |
| 6,717,526 | B2 | 4/2004 | Martineau et al. |
| 6,720,745 | B2 | 4/2004 | Lys et al. |
| 6,726,348 | B2 | 4/2004 | Gloisten |
| 6,736,328 | B1 | 5/2004 | Takusagawa |
| 6,736,525 | B2 | 5/2004 | Chin |
| 6,741,324 | B1 | 5/2004 | Kim |
| D491,678 | S | 6/2004 | Piepgras |
| D492,042 | S | 6/2004 | Piepgras |
| 6,744,223 | B2 | 6/2004 | Laflamme et al. |
| 6,748,299 | B1 | 6/2004 | Motoyama |
| 6,762,562 | B2 | 7/2004 | Leong |
| 6,768,047 | B2 | 7/2004 | Chang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,787,999 | B2 | 9/2004 | Stimac et al. |
| 6,788,000 | B2 | 9/2004 | Appelberg et al. |
| 6,788,011 | B2 | 9/2004 | Mueller et al. |
| 6,791,840 | B2 | 9/2004 | Chun |
| 6,796,680 | B1 | 9/2004 | Showers et al. |
| 6,799,864 | B2 | 10/2004 | Bohler et al. |
| 6,801,003 | B2 | 10/2004 | Schanberger et al. |
| 6,803,732 | B2 | 10/2004 | Kraus et al. |
| 6,806,659 | B1 | 10/2004 | Mueller et al. |
| 6,814,470 | B2 | 11/2004 | Rizkin et al. |
| 6,814,478 | B2 | 11/2004 | Menke |
| 6,815,724 | B2 | 11/2004 | Dry |
| 6,846,094 | B2 | 1/2005 | Luk |
| 6,851,816 | B2 | 2/2005 | Wu et al. |
| 6,851,832 | B2 | 2/2005 | Tieszen |
| 6,853,150 | B2 | 2/2005 | Clauberg et al. |
| 6,853,151 | B2 | 2/2005 | Leong et al. |
| 6,853,563 | B1 | 2/2005 | Yang et al. |
| 6,857,924 | B2 | 2/2005 | Fu et al. |
| 6,860,628 | B2 | 3/2005 | Robertson et al. |
| 6,866,401 | B2 | 3/2005 | Sommers et al. |
| 6,869,204 | B2 | 3/2005 | Morgan et al. |
| 6,871,981 | B2 | 3/2005 | Alexanderson et al. |
| 6,874,924 | B1 | 4/2005 | Hulse et al. |
| 6,879,883 | B1 | 4/2005 | Motoyama |
| 6,883,929 | B2 | 4/2005 | Dowling |
| 6,883,934 | B2 | 4/2005 | Kawakami et al. |
| 6,888,322 | B2 | 5/2005 | Dowling et al. |
| 6,897,624 | B2 | 5/2005 | Lys et al. |
| D506,274 | S | 6/2005 | Moriyama et al. |
| 6,909,239 | B2 | 6/2005 | Gauna |
| 6,909,921 | B1 | 6/2005 | Bilger |
| 6,918,680 | B2 | 7/2005 | Seeberger |
| 6,921,181 | B2 | 7/2005 | Yen |
| 6,926,419 | B2 | 8/2005 | An |
| 6,936,968 | B2 | 8/2005 | Cross et al. |
| 6,936,978 | B2 | 8/2005 | Morgan et al. |
| 6,940,230 | B2 | 9/2005 | Myron et al. |
| 6,948,829 | B2 | 9/2005 | Verdes et al. |
| 6,953,261 | B1 | 10/2005 | Jiao et al. |
| 6,957,905 | B1 | 10/2005 | Pritchard et al. |
| 6,963,175 | B2 | 11/2005 | Archenhold et al. |
| 6,964,501 | B2 | 11/2005 | Ryan |
| 6,965,197 | B2 | 11/2005 | Tyan et al. |
| 6,965,205 | B2 | 11/2005 | Piepgras et al. |
| 6,967,448 | B2 | 11/2005 | Morgan et al. |
| 6,969,179 | B2 | 11/2005 | Sloan et al. |
| 6,969,186 | B2 | 11/2005 | Sonderegger et al. |
| 6,969,954 | B2 | 11/2005 | Lys |
| 6,975,079 | B2 | 12/2005 | Lys et al. |
| 6,979,097 | B2 | 12/2005 | Elam et al. |
| 6,982,518 | B2 | 1/2006 | Chou et al. |
| 6,995,681 | B2 | 2/2006 | Pederson |
| 6,997,576 | B1 | 2/2006 | Lodhie et al. |
| 6,999,318 | B2 | 2/2006 | Newby |
| 7,004,603 | B2 | 2/2006 | Knight |
| D518,218 | S | 3/2006 | Roberge et al. |
| 7,008,079 | B2 | 3/2006 | Smith |
| 7,014,336 | B1 | 3/2006 | Ducharme et al. |
| 7,015,650 | B2 | 3/2006 | McGrath |
| 7,018,063 | B2 | 3/2006 | Michael et al. |
| 7,018,074 | B2 | 3/2006 | Raby et al. |
| 7,021,799 | B2 | 4/2006 | Mizuyoshi |
| 7,021,809 | B2 | 4/2006 | Iwasa et al. |
| 7,024,256 | B2 | 4/2006 | Krzyzanowski et al. |
| 7,029,145 | B2 | 4/2006 | Frederick |
| 7,031,920 | B2 | 4/2006 | Dowling et al. |
| 7,033,036 | B2 | 4/2006 | Pederson |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,048,423 | B2 | 5/2006 | Stepanenko et al. |
| 7,049,761 | B2 | 5/2006 | Timmermans et al. |
| 7,052,171 | B1 | 5/2006 | Lefebvre et al. |
| 7,053,557 | B2 | 5/2006 | Cross et al. |
| 7,064,498 | B2 | 6/2006 | Dowling et al. |
| 7,064,674 | B2 | 6/2006 | Pederson |
| 7,067,992 | B2 | 6/2006 | Leong et al. |
| 7,077,978 | B2 | 7/2006 | Setlur et al. |
| 7,080,927 | B2 | 7/2006 | Feuerborn et al. |
| 7,086,747 | B2 | 8/2006 | Nielson et al. |
| 7,088,014 | B2 | 8/2006 | Nierlich et al. |
| 7,088,904 | B2 | 8/2006 | Ryan, Jr. |
| 7,102,902 | B1 | 9/2006 | Brown et al. |

(56) References Cited

U.S. PATENT DOCUMENTS

| | | | |
|---|---|---|---|
| 7,113,541 | B1 | 9/2006 | Lys et al. |
| 7,114,830 | B2 | 10/2006 | Robertson et al. |
| 7,114,834 | B2 | 10/2006 | Rivas et al. |
| 7,118,262 | B2 | 10/2006 | Negley |
| 7,119,503 | B2 | 10/2006 | Kemper |
| 7,120,560 | B2 | 10/2006 | Williams et al. |
| 7,121,679 | B2 | 10/2006 | Fujimoto |
| 7,122,976 | B1 | 10/2006 | Null et al. |
| 7,123,139 | B2 | 10/2006 | Sweeney |
| 7,128,442 | B2 | 10/2006 | Lee et al. |
| 7,128,454 | B2 | 10/2006 | Kim et al. |
| D532,532 | S | 11/2006 | Maxik |
| 7,132,635 | B2 | 11/2006 | Dowling |
| 7,132,785 | B2 | 11/2006 | Ducharme |
| 7,132,804 | B2 | 11/2006 | Lys et al. |
| 7,135,824 | B2 | 11/2006 | Lys et al. |
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,244,058 | B2 | 7/2007 | DiPenti et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |

(56) References Cited

U.S. PATENT DOCUMENTS

| | | | |
|---|---|---|---|
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| D586,484 | S | 2/2009 | Liu et al. |
| D586,928 | S | 2/2009 | Liu et al. |
| 7,490,957 | B2 | 2/2009 | Leong et al. |
| 7,494,246 | B2 | 2/2009 | Harbers et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,511,613 | B2 | 3/2009 | Wang |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,592,757 | B2 | 9/2009 | Hargenrader et al. |
| 7,594,738 | B1 | 9/2009 | Lin et al. |
| D601,726 | S | 10/2009 | Mollaert et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,616,849 | B1 | 11/2009 | Simon |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| D610,724 | S | 2/2010 | Chiang et al. |
| 7,654,703 | B2 | 2/2010 | Kan et al. |
| 7,661,839 | B2 | 2/2010 | Tsai |
| D611,172 | S | 3/2010 | Lin et al. |
| D612,528 | S | 3/2010 | McGrath et al. |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| 7,855,641 | B1 | 12/2010 | Okafo |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| D634,452 | S | 3/2011 | de Visser |
| 7,904,209 | B2 | 3/2011 | Podgorny et al. |
| D636,504 | S | 4/2011 | Duster |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,976,185 | B2 | 7/2011 | Uang et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Trumble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,136,738 | B1 | 3/2012 | Kopp |
| 8,159,152 | B1 | 4/2012 | Salessi |
| D660,472 | S | 5/2012 | Aguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,230,690 | B1 | 7/2012 | Salessi |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,366,291 | B2 | 2/2013 | Hoffmann |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,398,275 | B2 | 3/2013 | Wang et al. |
| 8,403,692 | B2 | 3/2013 | Cao et al. |
| 8,405,314 | B2 | 3/2013 | Jensen |
| 8,434,914 | B2 | 5/2013 | Li et al. |
| 8,454,193 | B2 | 6/2013 | Simon et al. |
| 8,496,351 | B2 | 7/2013 | Lo et al. |
| 8,523,394 | B2 | 9/2013 | Simon et al. |
| 8,531,109 | B2 | 9/2013 | Visser et al. |
| 8,571,716 | B2 | 10/2013 | Ivey et al. |
| 8,628,216 | B2 | 1/2014 | Ivey et al. |
| 8,653,984 | B2 | 2/2014 | Ivey et al. |
| 8,870,412 | B1 | 10/2014 | Timmermans et al. |
| 9,016,895 | B2 | 4/2015 | Handsaker |
| 2001/0033488 | A1 | 10/2001 | Chliwnyj et al. |
| 2001/0045803 | A1 | 11/2001 | Cencur |
| 2002/0011801 | A1 | 1/2002 | Chang |
| 2002/0015297 | A1 | 2/2002 | Hayashi et al. |
| 2002/0038157 | A1 | 3/2002 | Dowling et al. |
| 2002/0041159 | A1 | 4/2002 | Kaping, Jr. |
| 2002/0044066 | A1 | 4/2002 | Dowling et al. |
| 2002/0047516 | A1 | 4/2002 | Iwasa et al. |
| 2002/0047569 | A1 | 4/2002 | Dowling et al. |
| 2002/0047624 | A1 | 4/2002 | Stam et al. |
| 2002/0047628 | A1 | 4/2002 | Morgan et al. |
| 2002/0048169 | A1 | 4/2002 | Dowling et al. |
| 2002/0057061 | A1 | 5/2002 | Mueller et al. |
| 2002/0060526 | A1 | 5/2002 | Timmermans et al. |
| 2002/0070688 | A1 | 6/2002 | Dowling et al. |
| 2002/0074559 | A1 | 6/2002 | Dowling et al. |
| 2002/0074958 | A1 | 6/2002 | Crenshaw |

(56) References Cited

U.S. PATENT DOCUMENTS

2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0175639 A1 11/2002 Pitigoi-Aron
2002/0176253 A1* 11/2002 Lee ..... 362/249
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222578 A1* 12/2003 Cok ..... 313/512
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini, II et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0044152 A1 3/2006 Wang
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0091826 A1 5/2006 Chen
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.

(56) References Cited

U.S. PATENT DOCUMENTS

| | | | |
|---|---|---|---|
| 2006/0109661 | A1 | 5/2006 | Coushaine et al. |
| 2006/0126325 | A1 | 6/2006 | Lefebvre et al. |
| 2006/0126338 | A1 | 6/2006 | Mighetto |
| 2006/0132061 | A1 | 6/2006 | McCormick et al. |
| 2006/0132323 | A1 | 6/2006 | Grady, Jr. |
| 2006/0146531 | A1 | 7/2006 | Reo et al. |
| 2006/0152172 | A9 | 7/2006 | Mueller et al. |
| 2006/0158881 | A1 | 7/2006 | Dowling |
| 2006/0170376 | A1 | 8/2006 | Piepgras et al. |
| 2006/0186214 | A1 | 8/2006 | Simon et al. |
| 2006/0192502 | A1 | 8/2006 | Brown et al. |
| 2006/0193131 | A1 | 8/2006 | McGrath et al. |
| 2006/0196953 | A1 | 9/2006 | Simon et al. |
| 2006/0197661 | A1 | 9/2006 | Tracy et al. |
| 2006/0198128 | A1 | 9/2006 | Piepgras et al. |
| 2006/0208667 | A1 | 9/2006 | Lys et al. |
| 2006/0215422 | A1 | 9/2006 | Laizure et al. |
| 2006/0220595 | A1 | 10/2006 | Lu |
| 2006/0221606 | A1 | 10/2006 | Dowling |
| 2006/0221619 | A1 | 10/2006 | Nishigaki |
| 2006/0227558 | A1 | 10/2006 | Osawa et al. |
| 2006/0232974 | A1 | 10/2006 | Lee et al. |
| 2006/0238884 | A1 | 10/2006 | Jang et al. |
| 2006/0262516 | A9 | 11/2006 | Dowling et al. |
| 2006/0262521 | A1 | 11/2006 | Piepgras et al. |
| 2006/0262544 | A1 | 11/2006 | Piepgras et al. |
| 2006/0262545 | A1 | 11/2006 | Piepgras et al. |
| 2006/0265921 | A1 | 11/2006 | Korall et al. |
| 2006/0273741 | A1 | 12/2006 | Stalker, III |
| 2006/0274529 | A1 | 12/2006 | Cao |
| 2006/0285325 | A1 | 12/2006 | Ducharme et al. |
| 2007/0035255 | A1 | 2/2007 | Shuster et al. |
| 2007/0035538 | A1 | 2/2007 | Garcia et al. |
| 2007/0035965 | A1 | 2/2007 | Holst |
| 2007/0040516 | A1 | 2/2007 | Chen |
| 2007/0041220 | A1 | 2/2007 | Lynch |
| 2007/0047227 | A1 | 3/2007 | Ducharme |
| 2007/0053182 | A1 | 3/2007 | Robertson |
| 2007/0053208 | A1 | 3/2007 | Justel et al. |
| 2007/0057805 | A1 | 3/2007 | Gomez |
| 2007/0064419 | A1 | 3/2007 | Gandhi |
| 2007/0064425 | A1 | 3/2007 | Frecska et al. |
| 2007/0070621 | A1 | 3/2007 | Rivas et al. |
| 2007/0070631 | A1 | 3/2007 | Huang et al. |
| 2007/0081423 | A1 | 4/2007 | Chien |
| 2007/0086754 | A1 | 4/2007 | Lys et al. |
| 2007/0086912 | A1 | 4/2007 | Dowling et al. |
| 2007/0097678 | A1 | 5/2007 | Yang |
| 2007/0109763 | A1 | 5/2007 | Wolf et al. |
| 2007/0115658 | A1 | 5/2007 | Mueller et al. |
| 2007/0115665 | A1 | 5/2007 | Mueller et al. |
| 2007/0120463 | A1 | 5/2007 | Hayashi et al. |
| 2007/0120594 | A1 | 5/2007 | Balakrishnan et al. |
| 2007/0127234 | A1 | 6/2007 | Jervey, III |
| 2007/0133202 | A1 | 6/2007 | Huang et al. |
| 2007/0139938 | A1 | 6/2007 | Petroski et al. |
| 2007/0145915 | A1 | 6/2007 | Roberge et al. |
| 2007/0146126 | A1 | 6/2007 | Wang |
| 2007/0147046 | A1 | 6/2007 | Arik et al. |
| 2007/0152797 | A1 | 7/2007 | Chemel et al. |
| 2007/0152808 | A1 | 7/2007 | LaCasse |
| 2007/0153514 | A1 | 7/2007 | Dowling et al. |
| 2007/0159828 | A1 | 7/2007 | Wang |
| 2007/0165402 | A1 | 7/2007 | Weaver, Jr. et al. |
| 2007/0165405 | A1 | 7/2007 | Chen |
| 2007/0173978 | A1 | 7/2007 | Fein et al. |
| 2007/0177382 | A1 | 8/2007 | Pritchard et al. |
| 2007/0182387 | A1 | 8/2007 | Weirich |
| 2007/0188114 | A1 | 8/2007 | Lys et al. |
| 2007/0188427 | A1 | 8/2007 | Lys et al. |
| 2007/0189026 | A1 | 8/2007 | Chemel et al. |
| 2007/0195526 | A1 | 8/2007 | Dowling et al. |
| 2007/0195527 | A1 | 8/2007 | Russell |
| 2007/0195532 | A1 | 8/2007 | Reisenauer et al. |
| 2007/0200725 | A1 | 8/2007 | Fredericks et al. |
| 2007/0205712 | A1 | 9/2007 | Radkov et al. |
| 2007/0206375 | A1 | 9/2007 | Piepgras et al. |
| 2007/0211461 | A1 | 9/2007 | Harwood |
| 2007/0211463 | A1 | 9/2007 | Chevalier et al. |
| 2007/0228999 | A1 | 10/2007 | Kit |
| 2007/0235751 | A1 | 10/2007 | Radkov et al. |
| 2007/0236156 | A1 | 10/2007 | Lys et al. |
| 2007/0236358 | A1 | 10/2007 | Street et al. |
| 2007/0237284 | A1 | 10/2007 | Lys et al. |
| 2007/0240346 | A1 | 10/2007 | Li et al. |
| 2007/0241657 | A1 | 10/2007 | Radkov et al. |
| 2007/0242466 | A1 | 10/2007 | Wu et al. |
| 2007/0247450 | A1 | 10/2007 | Lee |
| 2007/0247842 | A1 | 10/2007 | Zampini et al. |
| 2007/0247847 | A1 | 10/2007 | Villard |
| 2007/0247851 | A1 | 10/2007 | Villard |
| 2007/0252161 | A1 | 11/2007 | Meis et al. |
| 2007/0258231 | A1 | 11/2007 | Koerner et al. |
| 2007/0258240 | A1 | 11/2007 | Ducharme et al. |
| 2007/0263379 | A1 | 11/2007 | Dowling |
| 2007/0274070 | A1 | 11/2007 | Wedell |
| 2007/0281520 | A1 | 12/2007 | Insalaco et al. |
| 2007/0285926 | A1 | 12/2007 | Maxik |
| 2007/0285933 | A1 | 12/2007 | Southard et al. |
| 2007/0290625 | A1 | 12/2007 | He et al. |
| 2007/0291483 | A1 | 12/2007 | Lys |
| 2007/0296350 | A1 | 12/2007 | Maxik et al. |
| 2008/0003664 | A1 | 1/2008 | Tysoe et al. |
| 2008/0007945 | A1 | 1/2008 | Kelly et al. |
| 2008/0012502 | A1 | 1/2008 | Lys |
| 2008/0012506 | A1 | 1/2008 | Mueller et al. |
| 2008/0013316 | A1 | 1/2008 | Chiang |
| 2008/0013324 | A1 | 1/2008 | Yu |
| 2008/0018261 | A1 | 1/2008 | Kastner |
| 2008/0024067 | A1 | 1/2008 | Ishibashi |
| 2008/0037226 | A1 | 2/2008 | Shin et al. |
| 2008/0037245 | A1 | 2/2008 | Chan |
| 2008/0037284 | A1 | 2/2008 | Rudisill |
| 2008/0049434 | A1 | 2/2008 | Marsh |
| 2008/0055894 | A1 | 3/2008 | Deng |
| 2008/0062680 | A1 | 3/2008 | Timmermans et al. |
| 2008/0068838 | A1 | 3/2008 | Galke et al. |
| 2008/0068839 | A1 | 3/2008 | Matheson |
| 2008/0074872 | A1 | 3/2008 | Panotopoulos |
| 2008/0089075 | A1 | 4/2008 | Hsu |
| 2008/0092800 | A1 | 4/2008 | Smith et al. |
| 2008/0093615 | A1 | 4/2008 | Lin et al. |
| 2008/0093998 | A1 | 4/2008 | Dennery et al. |
| 2008/0094819 | A1 | 4/2008 | Vaish |
| 2008/0094837 | A1 | 4/2008 | Dobbins et al. |
| 2008/0129211 | A1 | 6/2008 | Lin et al. |
| 2008/0130267 | A1 | 6/2008 | Dowling et al. |
| 2008/0150444 | A1 | 6/2008 | Usui et al. |
| 2008/0151535 | A1 | 6/2008 | de Castris |
| 2008/0158871 | A1 | 7/2008 | McAvoy et al. |
| 2008/0158887 | A1 | 7/2008 | Zhu et al. |
| 2008/0164826 | A1 | 7/2008 | Lys |
| 2008/0164827 | A1 | 7/2008 | Lys |
| 2008/0164854 | A1 | 7/2008 | Lys |
| 2008/0175003 | A1 | 7/2008 | Tsou et al. |
| 2008/0180036 | A1 | 7/2008 | Garrity et al. |
| 2008/0185961 | A1 | 8/2008 | Hong |
| 2008/0186704 | A1 | 8/2008 | Chou et al. |
| 2008/0192436 | A1 | 8/2008 | Peng et al. |
| 2008/0198598 | A1 | 8/2008 | Ward |
| 2008/0211386 | A1 | 9/2008 | Choi et al. |
| 2008/0211419 | A1 | 9/2008 | Garrity |
| 2008/0218993 | A1 | 9/2008 | Li |
| 2008/0224629 | A1 | 9/2008 | Melanson |
| 2008/0224636 | A1 | 9/2008 | Melanson |
| 2008/0253125 | A1 | 10/2008 | Kang et al. |
| 2008/0258631 | A1 | 10/2008 | Wu et al. |
| 2008/0258647 | A1 | 10/2008 | Scianna |
| 2008/0265799 | A1 | 10/2008 | Sibert |
| 2008/0278092 | A1 | 11/2008 | Lys et al. |
| 2008/0285257 | A1 | 11/2008 | King |
| 2008/0285266 | A1 | 11/2008 | Thomas |
| 2008/0290814 | A1 | 11/2008 | Leong et al. |
| 2008/0291675 | A1 | 11/2008 | Lin et al. |

(56) References Cited

U.S. PATENT DOCUMENTS

2008/0298080 A1 12/2008 Wu et al.
2008/0304249 A1* 12/2008 Davey et al. ..... 362/20
2008/0310119 A1 12/2008 Giacoma
2008/0315773 A1 12/2008 Pang
2008/0315784 A1 12/2008 Tseng
2009/0002995 A1 1/2009 Lee et al.
2009/0016063 A1 1/2009 Hu
2009/0016068 A1 1/2009 Chang
2009/0018954 A1 1/2009 Roberts
2009/0021140 A1 1/2009 Takasu et al.
2009/0032604 A1 2/2009 Miller
2009/0033513 A1 2/2009 Salsbury et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0065596 A1 3/2009 Seem et al.
2009/0067170 A1 3/2009 Bloemen et al.
2009/0067182 A1 3/2009 Hsu et al.
2009/0072945 A1 3/2009 Pan et al.
2009/0073693 A1 3/2009 Nall et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0115597 A1 5/2009 Giacalone
2009/0122571 A1 5/2009 Simmons et al.
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0296017 A1 12/2009 Itoh et al.
2009/0302730 A1* 12/2009 Carroll et al. ..... 313/46
2009/0303720 A1 12/2009 McGrath
2009/0316408 A1 12/2009 Villard
2010/0002453 A1* 1/2010 Wu et al. ..... 362/373
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046222 A1 2/2010 Yang
2010/0061598 A1 3/2010 Seo
2010/0071946 A1 3/2010 Hashimoto
2010/0072904 A1 3/2010 Eckel et al.
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0106306 A1 4/2010 Simon et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0177532 A1 7/2010 Simon et al.
2010/0181178 A1 7/2010 Chang et al.
2010/0207547 A1 8/2010 Kuroki et al.
2010/0220469 A1 9/2010 Ivey et al.
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0320922 A1 12/2010 Palazzolo et al.
2011/0006658 A1 1/2011 Chan et al.
2011/0090682 A1 4/2011 Zheng et al.
2011/0109454 A1 5/2011 McSheffrey, Sr. et al.
2011/0140136 A1 6/2011 Daily et al.
2011/0141745 A1 6/2011 Gu et al.
2011/0149564 A1 6/2011 Hsia et al.
2011/0156584 A1 6/2011 Kim
2011/0176298 A1 7/2011 Meurer et al.
2011/0199723 A1 8/2011 Sato
2011/0199769 A1 8/2011 Bretschneider et al.
2011/0204777 A1 8/2011 Lenk
2011/0280010 A1 11/2011 Ou et al.
2011/0291588 A1 12/2011 Tagare
2012/0008315 A1 1/2012 Simon et al.
2012/0014086 A1 1/2012 Jonsson
2012/0043892 A1 2/2012 Visser et al.
2012/0063140 A1 3/2012 Kong
2012/0098439 A1 4/2012 Recker et al.
2012/0106144 A1 5/2012 Chang
2012/0106153 A1* 5/2012 Huang et al. ..... 362/249.02
2012/0113628 A1 5/2012 Burrow et al.
2012/0120660 A1 5/2012 Grauvogel
2012/0127726 A1 5/2012 Yen
2012/0139417 A1 6/2012 Mironichev et al.
2012/0146503 A1 6/2012 Negley et al.
2012/0147597 A1 6/2012 Farmer
2012/0153865 A1 6/2012 Rolfes et al.
2012/0155073 A1 6/2012 McCanless et al.
2012/0161666 A1 6/2012 Antony et al.
2012/0194086 A1 8/2012 Liu et al.
2012/0195032 A1 8/2012 Shew
2012/0212951 A1 8/2012 Lai et al.
2012/0212953 A1 8/2012 Bloom et al.
2012/0230044 A1 9/2012 Zhang et al.
2012/0236533 A1 9/2012 Nakamura et al.
2012/0236554 A1 9/2012 Rust
2012/0243216 A1 9/2012 Lai et al.
2012/0243217 A1 9/2012 Szprengiel et al.
2012/0274214 A1 11/2012 Radermacher et al.
2012/0275154 A1 11/2012 Hood et al.
2012/0293991 A1 11/2012 Lin
2012/0293996 A1 11/2012 Thomas et al.
2012/0300409 A1 11/2012 Lee
2012/0300445 A1 11/2012 Chu et al.
2012/0300468 A1 11/2012 Chang et al.
2012/0300486 A1 11/2012 Matsushita et al.
2012/0307524 A1 12/2012 Schapira et al.
2012/0320598 A1 12/2012 Son
2013/0010473 A1 1/2013 Dellian et al.
2013/0039051 A1 2/2013 Wu
2013/0044471 A1 2/2013 Chen
2013/0044476 A1 2/2013 Bretschneider et al.
2013/0050997 A1 2/2013 Bretschneider et al.
2013/0050998 A1 2/2013 Chu et al.
2013/0057146 A1 3/2013 Chao
2013/0058079 A1 3/2013 Dellian et al.
2013/0063944 A1 3/2013 Lodhie et al.
2013/0077297 A1 3/2013 Wu et al.
2013/0094200 A1 4/2013 Dellian et al.
2013/0147381 A1 6/2013 Yang
2013/0148349 A1 6/2013 Pasqualini et al.
2013/0206597 A1 8/2013 Wang et al.
2013/0242553 A1 9/2013 Feng et al.
2013/0250610 A1 9/2013 Brick et al.
2014/0009926 A1 1/2014 Simon et al.

FOREIGN PATENT DOCUMENTS

CN 2869556 Y 2/2007
CN 101016976 A 8/2007
CN 101075605 A 11/2007
CN 201129681 Y 10/2008

(56) References Cited

FOREIGN PATENT DOCUMENTS

| | | | |
|---|---|---|---|
| CN | 201184574 | Y | 1/2009 |
| CN | 101737664 | A1 | 6/2010 |
| DE | 19651140 | A1 | 6/1997 |
| DE | 19624087 | A1 | 12/1997 |
| DE | 29819966 | U1 | 3/1999 |
| DE | 29817609 | U1 | 1/2000 |
| DE | 20018865 | U1 | 2/2001 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0714556 | | 1/1991 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | | 1/1995 |
| EP | 0432848 | B1 | 4/1995 |
| EP | 0659531 | A1 | 6/1995 |
| EP | 0403001 | B1 | 8/1995 |
| EP | 0525876 | | 5/1996 |
| EP | 0889283 | A1 | 7/1999 |
| EP | 0458408 | B1 | 9/1999 |
| EP | 0578302 | B1 | 9/1999 |
| EP | 0723701 | B1 | 1/2000 |
| EP | 1142452 | B1 | 3/2001 |
| EP | 0787419 | B1 | 5/2001 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | A1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | B1 | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2165977 | A | 4/1986 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| JP | S62241382 | | 10/1987 |
| JP | 06-054289 | | 2/1994 |
| JP | H6-54103 | U | 7/1994 |
| JP | 07-249467 | | 9/1995 |
| JP | 7264036 | | 10/1995 |
| JP | 08-162677 | A | 6/1996 |
| JP | H10308536 | | 11/1998 |
| JP | 11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 2002289373 | A | 10/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006012859 | A | 1/2006 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2009283183 | A | 12/2009 |
| JP | 4491695 | B1 | 6/2010 |
| JP | 2010-192229 | A1 | 9/2010 |
| JP | 2010-205553 | A | 9/2010 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | 99-06759 | A1 | 2/1999 |
| WO | 99-10867 | A1 | 3/1999 |
| WO | 99-31560 | A2 | 6/1999 |
| WO | 99/45312 | A1 | 9/1999 |
| WO | 99/57945 | A1 | 11/1999 |
| WO | 00/01067 | A2 | 1/2000 |
| WO | WO0225842 | A2 | 3/2002 |
| WO | 02-061330 | | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |

(56) References Cited

FOREIGN PATENT DOCUMENTS

| | | | |
|---|---|---|---|
| WO | WO03026358 | A1 | 3/2003 |
| WO | WO03055273 | A2 | 7/2003 |
| WO | WO03067934 | A2 | 8/2003 |
| WO | WO03090890 | A1 | 11/2003 |
| WO | WO03096761 | A1 | 11/2003 |
| WO | WO2004021747 | A2 | 3/2004 |
| WO | WO2004023850 | A2 | 3/2004 |
| WO | WO2004032572 | A2 | 4/2004 |
| WO | WO2004057924 | | 7/2004 |
| WO | WO2004100624 | A2 | 11/2004 |
| WO | WO2005031860 | A2 | 4/2005 |
| WO | WO2005052751 | A2 | 6/2005 |
| WO | WO2005060309 | A2 | 6/2005 |
| WO | WO2005084339 | A2 | 9/2005 |
| WO | WO2005089293 | A2 | 9/2005 |
| WO | WO2005089309 | A2 | 9/2005 |
| WO | WO2005103555 | A1 | 11/2005 |
| WO | WO2005116519 | A1 | 12/2005 |
| WO | WO2006023149 | A2 | 3/2006 |
| WO | WO2006044328 | A1 | 4/2006 |
| WO | WO2006046207 | A1 | 5/2006 |
| WO | WO2006056120 | A1 | 6/2006 |
| WO | WO2006093889 | A2 | 9/2006 |
| WO | WO2006127666 | A2 | 11/2006 |
| WO | WO2006127785 | A2 | 11/2006 |
| WO | WO2006133272 | A2 | 12/2006 |
| WO | WO2006137686 | A1 | 12/2006 |
| WO | WO2007004679 | A1 | 1/2007 |
| WO | WO2007081674 | A1 | 7/2007 |
| WO | WO2007090292 | A1 | 8/2007 |
| WO | WO2007094810 | A2 | 8/2007 |
| WO | WO2008018002 | A2 | 2/2008 |
| WO | WO2008027093 | A2 | 3/2008 |
| WO | WO2008061991 | A1 | 5/2008 |
| WO | WO2008110978 | A1 | 9/2008 |
| WO | WO2008137460 | A2 | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A3 | 4/2010 |
| WO | WO2010047898 | A3 | 4/2010 |
| WO | WO2010047973 | A3 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | A2 | 1/2011 |
| WO | WO2011005579 | A2 | 1/2011 |
| WO | WO2011072308 | A1 | 6/2011 |
| WO | WO2011113709 | A2 | 9/2011 |
| WO | WO2011117059 | A1 | 9/2011 |
| WO | WO2012001584 | A1 | 1/2012 |
| WO | WO2012004708 | A2 | 1/2012 |
| WO | WO2012007899 | A1 | 1/2012 |
| WO | WO2012025626 | A1 | 3/2012 |
| WO | WO2012063174 | A1 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | 2013/097823 | A1 | 7/2013 |
| WO | 2013/098700 | A1 | 7/2013 |
| WO | WO2013132383 | A1 | 9/2013 |
| WO | WO2013135527 | A1 | 9/2013 |

OTHER PUBLICATIONS

International Search Report and Written Opinion dated Feb. 9, 2012 from the corresponding International Application No. PCT/US2011/043524 filed on Jul. 11, 2011.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

D.N.A.-III, [online], [retrieved Mar. 10, 2009] Retrieved from the PLC Lighting Web Page using Internet <URL: http://www.plclighting.com/product_info.php?cPath=1&products_id=92>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10>.

E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.

E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbn11871.html>.

LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.

LED Lights, Replacement LED lamps for any incandescent light, [online], [retrieved on Jan. 13, 2000] Retrieved from LED Lights Web Page using Internet <URL: http://www.ledlights.com/replac.htm>.

LEDTRONICS, LEDTRONICS Catalog, 1996, p. 10, LEDTRONICS, Torrance, California.

Phason Electronic Control Systems, Light Level Controller (LLC) case study. Nov. 30, 2004. 3 pages, Phason Inc., Winnipeg, Manitoba, Canada.

Philips. Sense and Simplicity—Licensing program for LED Luminaires and Retrofits, Philips Intellectual Property & Standards, May 5, 2009.

Piper. The Best Path to Efficiency. Building Operating Management, Trade Press Publishing Company May 2000 [online], [retrieved on

(56) References Cited

OTHER PUBLICATIONS

Jan. 17, 2008]. Retrieved from Find Articles Web Page using Internet <URL:http://findarticles.com/p/articles/mi_qu3922/is_200005/ai_n8899499/>.
European Office Action in EP098224249, a related matter, mailed Jan. 13, 2015, 2 pages.
Extended European Search Report for European Application No. 09822382.9 mailed on Sep. 19, 2014 in 8 pages.
ISR & WO for PCT/US2015011711 dated Mar. 23, 2015.
Office Action in related Japanese matter, dated Feb. 24, 2015.
PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.
PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.
Saha et al, "Location Determination of a Mobile Device using IEEE 802.11 Access Point Signals", May 5, 2002 in 20 pages.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
International Search Report and Written Opinion dated Feb. 15, 2013 from the corresponding International Application No. PCT/US2012/052244 filed on Aug. 24, 2012.
International Search Report and Written Opinion dated Aug. 30, 2011 for the corresponding International Application No. PCT/US2011/029994 filed Mar. 25, 2011.
Notification of Transmittal, the International Search Report and the Written Opinion of the International Searching Authority dated May 7, 2012, from the corresponding International Application No. PCT/US2011/064151.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
International Report on Patentability dated May 24, 2010 from the corresponding International Application No. PCT/US2009/060087 filed Oct. 9, 2009.
Extended European Search Report for co-pending European Application No. 10 73 2124 mailed on Dec. 13, 2012 in 8 pages.
Extended European Search Report for co-pending European Application No. 09822425.6 mailed on Aug. 30, 2012 in 9 pages.
Extended European Search Report for co-pending European Application No. 10797596.3 mailed on Jan. 17, 2013 in 11pages.
Extended European Search Report for co-pending European Application No. 10736237.8 mailed on Oct. 19, 2012 in 5 pages.
Extended European Search Report for co-pending European Application No. 10738925.6 mailed on Oct. 1, 2012 in 7 pages.
Examination and Search Report mailed on Jul. 2, 2012 in cooresponding United Kingdom Application No. 1018896.9 in 4 pages.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
Notification of Transmittal, the International Search Report and the Written Opinion of the International Searching Authority dated May 7, 2012 from the corresponding International Application No. PCT/US2011/058312.

(56) References Cited

OTHER PUBLICATIONS

International Search Report and Written Opinion dated Aug. 25, 2009 from corresponding International Application No. PCT/US2009/031049 filed Jan. 15, 2009.

International Search Report and Written Opinion dated Jan. 25, 2010 from the corresponding International Application No. PCT/US2009/048623 filed Jun. 25, 2009.

International Search Report and Written Opinion dated Feb. 26, 2010 from the corresponding International Application No. PCT/US2009/050949 filed Jul. 17, 2009.

International Search Report and Written Opinion dated Apr. 30, 2010 from the corresponding International Application No. PCT/US2009/057072 filed on Sep. 16, 2009.

International Search Report and Written Opinion dated Jul. 30, 2010 from the corresponding International Application No. PCT/US2010/021448 filed on Jan. 20, 2010.

International Search Report and Written Opinion dated Sep. 30, 2011 from the corresponding International Application No. PCT/US2011/029905 filed on Mar. 25, 2011.

* cited by examiner

LED BULB FOR INCANDESCENT BULB REPLACEMENT WITH INTERNAL HEAT DISSIPATING STRUCTURES

CROSS REFERENCE TO RELATED APPLICATION

This application is a continuation of U.S. patent application Ser. No. 14/032,488 filed Sep. 20, 2013, which is a continuation of U.S. patent application Ser. No. 13/071,985 filed Mar. 25, 2011, now U.S. Pat. No. 8,540,401, which claims priority to U.S. Provisional Patent Application No. 61/317,871 filed Mar. 26, 2010, all of which are incorporated herein by reference in their entireties.

TECHNICAL FIELD

The invention relates to a light emitting diode (LED) based light, for example, an LED-based light bulb usable in an Edison-type fixture in place of a conventional incandescent bulb.

BACKGROUND

Incandescent light bulbs are commonly used in many environments, such as households, commercial buildings, and advertisement lighting, and in many types of fixtures, such as desk lamps and overhead fixtures. Incandescent bulbs can each have a threaded electrical connector for use in Edison-type fixtures, though incandescent bulbs can include other types of electrical connectors such as a bayonet connector or pin connector. Incandescent light bulbs generally consume large amounts of energy and have short life-spans. Indeed, many countries have begun phasing out or plan to phase out the use of incandescent light bulbs entirely.

Compact fluorescent light bulbs (CFLs) are gaining popularity as replacements for incandescent light bulbs. CFLs are typically much more energy efficient than incandescent light bulbs, and CFLs typically have much longer life-spans than incandescent light bulbs. However, CFLs contain mercury, a toxic chemical, which makes disposal of CFLs difficult. Additionally, CFLs require a momentary start-up period before producing light, and many consumers do not find CFLs to produce light of similar quality to incandescent bulbs. Further, CFLs are often larger than incandescent lights of similar luminosity, and some consumers find CFLs unsightly when not lit.

Known LED-based light bulbs have been developed as an alternative to both incandescent light bulbs and CFLs. Known LED light bulbs typically each include a base that functions as a heat sink and has an electrical connector at one end, a group of LEDs attached to the base, and a bulb. The bulb often has a semi-circular shape with its widest portion attached to the base such that the bulb protects the LEDs.

SUMMARY

Known LED-based light bulbs suffer from multiple drawbacks. A base of a typical known LED-based light bulb is unable to dissipate a large amount of heat, which in turn limits the amount of power that can be supplied to LEDs in the typical known LED-based light bulb without a high risk of the LEDs overheating. As a result of the power supplied to the LEDs being limited, the typical known LED-based light bulb has a limited luminosity and cannot provide as much light as an incandescent light bulb that the LED-based light bulb is intended to replace.

In an effort to increase the luminosity of known LED-based light bulbs, some known LED-based light bulbs include over-sized bases having large surface areas. The large surface areas of the over-sized bases are intended to allow the bases to dissipate sufficient amounts of heat such that the LEDs of each known LED-based light can be provided with enough power to produce in the aggregate as much luminosity as the respective incandescent bulbs that the LED-based light bulbs are intended to replace. However, the total size of one of the LED-based lights is often limited, such as due to a fixture size constraint. For example, a desk lamp may only be able to accept a bulb having a three to four inch diameter, in which case the over-sized base of an LED-based light should not exceed three to four inches in diameter. Thus, the size of the over-sized base for the known LED-based light bulb is constrained, and heat dissipation remains problematic.

Further, the use of over-sized bases in some known LED-based light bulbs detracts from the distributions of light emanating from the bulbs. That is, for a typical known LED-based light bulb having one of the over-sized bases, the over-sized base has a diameter as large as or larger than a maximum diameter of the bulb of the known LED-based light bulb. As a result of its small bulb diameter to base diameter ratio, the base blocks light that has been reflected by the bulb and would otherwise travel in a direction toward an electrical connector at an end of the base. The typical known LED-based light bulb thus does not direct much light in a direction toward the electrical connector. For example, when the typical known LED-based light bulb having an over-sized base is installed in a lamp or other fixture in which the bulb is oriented with its base below its bulb, very little light is directed downward. Thus, the use of over-sized bases can also prevent known LED-based lights from closely replicating the light distribution of incandescent bulbs.

In addition to using over-sized bases, other attempts have been made to increase the ability of known LED-based light bulbs to dissipate heat. For example, bases of some known LED-based light bulbs include motorized fans for increasing the amounts of airflow experienced by the bases. However, known LED-based light bulbs including fans often produce audible noise and are expensive to produce. As another example, bases of known LED-based lights have been provided with axially extending ribs in an attempt to increase the surface areas of the bases without too greatly increasing the diameters of the bases. However, such ribs often have the effect of acting as a barrier to air flow and, as a result, tend to stall air flow relative to the base. As a result, bases with ribs typically do not provide a sufficient amount of heat dissipation. As yet another example, fluid fill LED-based lights have been introduced, with the fluid intended to efficiently transfer heat from LEDs to outside shells of the lamps. However, these lamps are at risk for leaking or spilling their fluid, and allowance must be made for thermal expansion of the fluid, thereby reducing the heat-transferring ability of the lamps.

Examples of "inside-out" LED-based bulbs described herein can have advantages over known LED-based light bulbs. For example, an example of an inside-out LED-based bulb can include a base. The base can include a physical and/or electrical connector on one of its ends, and the base can define a compartment that can contain electronics such as a power converter and/or any other electronics in electric communication with the electrical connector. One or more LEDs can be mounted on an opposing end of the base and if more than one LED is included the LEDs can be mounted on an annular circuit board that is in electrical communication with the electronics. An annular light pipe can be positioned over the LEDs such that light produced by the LEDs enters the light pipe. High-surface area heat dissipating structures, such as fins or pins, can extend from the base through a cavity defined by the annular light pipe. A thermal shroud can be positioned over distal ends of the heat dissipating structures to protect against, as an example, inadvertent contact of a hand with one or more of the heat dissipating structures. An additional group of LEDs can optionally be mounted on a distal end of the heat dissipating structures interior of the thermal shroud. Other inside-out LED-based bulb configurations are also described herein.

In operation, the inside-out LED-based bulb can be engaged with a conventional fixture designed to receive, for example, an incandescent bulb. When powered, the electronics of the LED-based bulb can convert power received from the fixture via the electrical connector to a type of power suitable for the LEDs, and that power can be transferred to the LEDs via the circuit board. As such, the LEDs can produce light, and that light can enter the light pipe, which can in turn distribute the light in a manner closely replicating an incandescent bulb. Moreover, heat produced by the LEDs can pass to the base via the circuit board, and from the base to the heat dissipating structures. The surface area of the heat dissipating structures can be large enough to dissipate a sufficient amount of heat to allow the LEDs to use an amount of power sufficient for the LEDs to replicate an incandescent bulb. Additionally, as a result of the location of the heat dissipating structures—inside the cavity defined by the annular light pipe—the structures do not interfere with the distribution of light. Thus, inside-out LED-based lights as described herein can each produce a sufficient amount of light to replicate incandescent bulbs without overheating because of their heat dissipating ability, and the lights can produce that light in a distribution closely replicating an incandescent bulb because a large light blocking base acting as a heat sink can be avoided.

One aspect of an "inside-out" LED based light for replacing an incandescent bulb comprises: a base having a first end and a second end; a connector fixed to the first end of the base, the connector adapted to physically connect to an incandescent light fixture; an open-ended light structure extending from the second end of the base, the light structure having an inner surface defining a cavity in fluid communication with an ambient environment and an opposing exterior outer surface; at least one LED arranged outward from the inner surface; and a heat dissipating structure for the at least one LED extending into the cavity.

In another aspect, an LED based light comprises: a base; a connector fixed to the base, the connector adapted to physically connect to an incandescent light fixture; an open-ended annular flange extending from the base along a longitudinal axis of the light, the flange having an inner surface defining a cavity in fluid communication with an ambient environment and an opposing exterior outer surface; at least one LED mounted to the outer surface; and a heat dissipating structure for the at least one LED extending into the cavity.

These and additional aspects will be described in additional detail below.

BRIEF DESCRIPTION OF THE DRAWINGS

The description herein makes reference to the accompanying drawings wherein like reference numerals refer to like parts throughout the several views, and wherein.

DESCRIPTION

Figure 1:
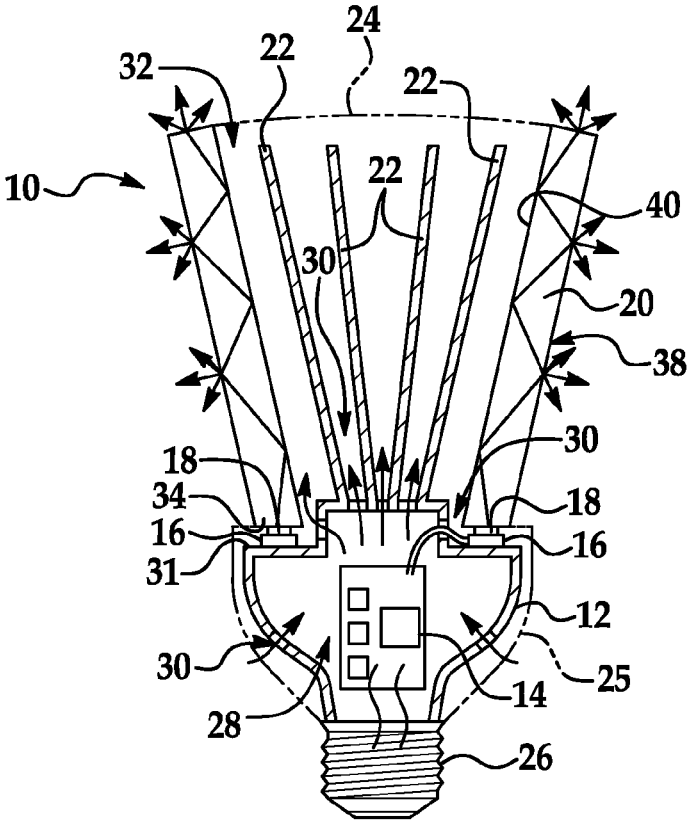
FIG. 1 is a cross sectional view of an example of an inside-out LED-based bulb taken along a longitudinal axis of the LED-based bulb.
Figure 3:
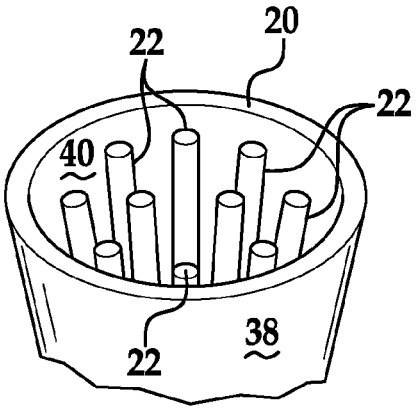
FIG. 3 is a partial perspective view of the bulb of FIG. 1.
Figure 4:
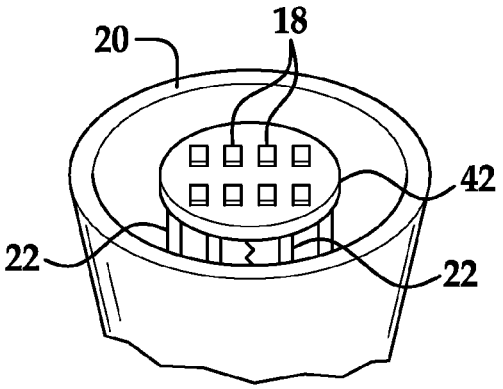
FIG. 4 is a partial perspective view of another example of an inside-out LED-based bulb.
Figure 5:
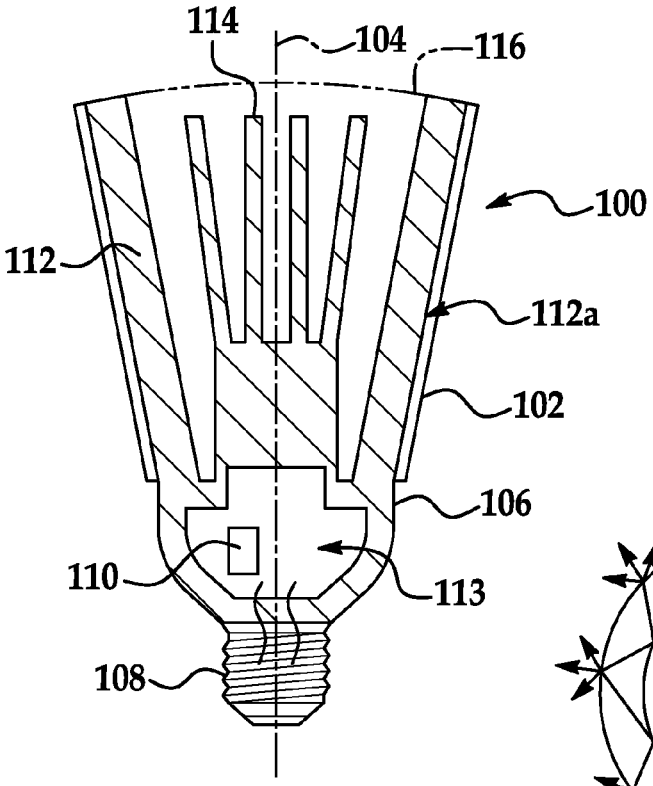
FIG. 5 is a cross sectional view of a yet another example of an inside-out LED-based bulb taken along a longitudinal axis of the LED-based bulb.

Examples of inside-out LED-based bulbs are discussed herein with reference to FIGS. 1-11. The bulbs are referred to as being "inside-out" because the bulbs can include heat dissipating structures located radially inward of a light source, such as a light pipe, relative to longitudinal axes of the bulbs. (An example of a longitudinal axis 104 is shown in FIG. 5, and the term radial refers to a direction orthogonal to a longitudinal axis unless otherwise indicated.) A first example of an inside-out LED-based bulb 10 in FIG. 1 is configured to replace a conventional incandescent light bulb in a conventional fixture, such as an Edison-type fixture. Alternatively, the bulb 10 can be configured to replace another type of bulb. The bulb 10 can include a base 12 that houses electronics 14, a circuit board 16, a plurality of LEDs 18, a light pipe 20, heat dissipating structures 22 and thermal shrouds 24 and 25.

One end of the base 12 can include an electrical connector 26. The electrical connector 26 as illustrated is of the Edison-type, although the base can alternatively include another type of electrical connector 26 such a bi-pin or bayonet type connector. The type of connector 26 can depend on the type of fixture that the bulb 10 is designed to be engaged with. In addition to providing an electrical connection between the bulb 10 and the fixture, the connector 26 can also serve to physically connect the bulb 10 to the fixture. For example, by screwing the connector 26 into engagement with an Edison-type fixture, the bulb 10 is both physically and electrically connected to the fixture. Additionally, the connector 26 can be in electrical communication with the electronics 14. For example, electrically conductive wires can link the connector 26 and electronics 14. The connector 26 can be snap-fit, adhered, or otherwise fixed to a remainder of the base 12. The base 12 can be constructed from a highly thermally conductive material, such as aluminum, another metal, or a highly thermally conductive polymer. The base 12 can be painted, powder-coated, or anodized to improve its thermal emissivity. For example, a thermally conductive, high emissivity paint (e.g., a paint having an emissivity of greater than 0.5) can be applied to at least a portion of an exterior of the base 12.

The base 12 can be hollow so as to define a compartment 28 large enough to receive electronics 14. The electronics 14 can include, as an example, power conversion electronics (e.g., a rectifier, a filtering capacitor, and/or DC to DC conversion circuitry) for modifying power receive from the connector 26 to power suitable for transmission to the circuit board 16. By forming the connector 26 separately from the remainder of the base 12 as mentioned above, the base 12 not including the connector 26 can define an opening for installation of the electronics 14. The opening in the base 12 can then be sealed when the connector 26 is fixed to the base 12.

The base 12 can define various apertures 30. The apertures 30 can be at one or more of a variety of locations, such as along the base 12 between connector 26 and the circuit board 16, adjacent and radially inward of the circuit board 16, and adjacent the heat dissipating structures 22. Each aperture 30 can provide a path of airflow between the compartment 28 and an ambient environment external the base 12. As a result, the apertures 30 can allow airflow between the compartment 28 and the ambient environment external the base 12, thereby facilitating heat transfer from the base 12 and electronics 14 to the ambient environment. Additionally, an electrical connection between the electronics 14 and circuit board 16 can pass through one or more of the apertures 30.

The base 12 can additionally define an annular platform 31. The platform 31 can be generally planar. The circuit board 16 can be annular and can be mounted on the platform 31. For example, the circuit board 16 can be attached to the platform 31 using thermally conductive tape or in another manner, such as using an adhesive or a snap-fit connection. The circuit board 16 can be electrically connected to the electronics 14, such as by way of electrically conductive wires extending through one or more of the apertures 30 and linking the circuit board 16 to the electronics 14.

The circuit board 16 can be an annular printed circuit board. Additionally, the circuit board 16 can be formed of multiple discrete circuit board sections, which can be electrically connected to one another using, for example, bridge connectors. For example, the circuit board 16 can be formed of multiple rectangular circuit boards arranged about the platform 31. Also, other types of circuit boards may be used, such as a metal core circuit board. Or, instead of a circuit board 16, other types of electrical connections (e.g., wires) can be used to electrically connect the LEDs 18 to each other and/or the electronics 14.

The LEDs 18 can be mounted on the circuit board 16 and in electrical communication therewith. As such, the LEDs 18 can be arranged in an annular configuration with the heat dissipating structures 22 extending from the base 12 radially inward of the LEDs 18. The LEDs 18 can be spaced at even intervals around the platform 31, although the LEDs 18 can alternatively be arranged in another fashion, such as in a pattern of two or more circles having different diameters. The LEDs 18 can be surface-mount devices of a type available from Nichia, though other types of LEDs can alternatively be used. For example, although surface-mounted LEDs 18 are shown, one or more organic LEDs can be used in place of or in addition thereto. Each LED 18 can include a single diode or multiple diodes, such as a package of diodes producing light that appears to an ordinary observer as coming from a single source. The LEDs 18 can be mounted on and electrically connected to the circuit board 16 using, for example, solder or another type of connection. The LEDs 18 can emit white light. However, LEDs that emit blue light, ultra-violet light or other wavelengths of light can be used in place of white light emitting LEDs 18.

The number and power level of the LEDs 18 can be selected such that the bulb 10 can produce a similar amount of luminosity as a conventional incandescent bulb that the bulb 10 is intended to be a substitute for. For example, if the bulb 10 is intended as a substitute for a 60 W incandescent bulb, the LEDs 18 in the aggregate can require 8-15 W of power, although this power level may change as LED technology improves. If the bulb 10 is intended to replicate another type of bulb, the LEDs 18 can output a different amount of light. The LEDs 18 can be oriented to face parallel to the longitudinal axis of the bulb 10, although the LEDs 18 can alternatively be oriented at an angle to the illustrated position.

Figure 2:
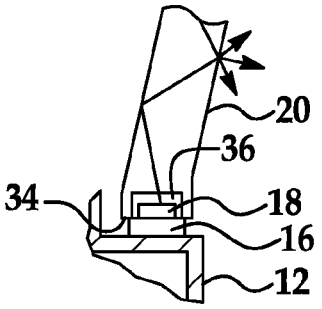
FIG. 2 is a blown-up view of a region of FIG. 1 including an LED and a proximal end of a light pipe.

The light pipe 20 can have a generally annular shape, and the light pipe 20 can define a cavity 32 radially inward of the light pipe 20. The light pipe 20 can be positioned to receive light produced by the LEDs 18. For example, the light pipe 20 can have an annular-shaped proximal end 34 that defines an annular cutaway 36 sized to receive the LEDs 18 as shown in FIG. 2. The cutaway 36 can be continuous and annular shaped, or can have an alternative shape such as a plurality of circumferentially spaced discrete indentations spaced in accordance with spacing of the LEDs 18. The light pipe 20 can be positioned such that the LEDs 16 are received in the cutaway 36.

Alternatively, the proximal end 34 can be planar and positioned against or slightly above the LEDs 18 with reference to the orientation shown in FIG. 1. As another alternative, if the light pipe 20 is hollow, the proximal end 34 can be an opening between radially spaced sidewalls of the light pipe 20. The light pipe 20 can be attached to the base 12 and/or the circuit board 14. For example, the light pipe 20 can be adhered or snap-fit to the base 12. Moreover, the light pipe 20 can be attached to the base radially outward of the circuit board 14 such that the base 12 and light pipe 20 effectively seal off the circuit board 14.

Figure 6:
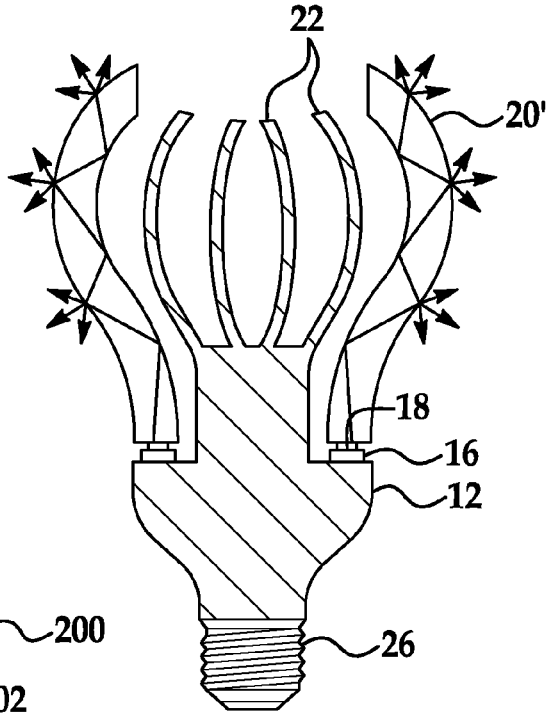
FIG. 6 is a cross sectional view of a still yet another example of an inside-out LED-based bulb taken along a longitudinal axis of the LED-based bulb.

The light pipe 20 can be optically configured to direct light produced by the LEDs 16 that enters the light pipe 20 in a distribution that appears to an ordinary observer to replicate the incandescent bulb which the bulb 10 is a substitute for, although the light pipe 20 can produce an alternative distribution of light depending on its configuration. Experimentation, a computational model or other means can be used to determine the specific shape of the light pipe 20 in order to achieve a certain light distribution. While the light pipe 20 shown in FIG. 1 has a conical shape including a linear outer radial surface 38 and a linear inner radial surface 40, both of which extend radially outward as the light pipe 20 extends away from the base 12, the light pipe 20 can have other shapes. For example, FIG. 6 shows a light pipe 20' having a bulbous profile similar to a conventional incandescent bulb. The bulbous profile of the light pipe 20' can have a more familiar appearance for consumers. Additionally, the light pipe 20' can provide a different light distribution than the light pipe 20, with the light pipe 20' distributing a greater amount of light in a longitudinal direction.

The shape of the light pipe 20 can be designed such that, as an example, the inner radial surface 40 causes total internal reflection of most light that contacts the surface 40, thereby reducing or eliminating the amount of light that enters the cavity 32. In addition to shaping the light pipe 20 to achieve a certain light distribution, other means for achieving a certain light distribution can also be used as discussed below with reference to FIG. 9. The light pipe 20 can be hollow or solid between surfaces 38 and 40.

The heat dissipating structures 22 can extend away from the base 12 within the cavity 32 defined by the light pipe 20, and the heat dissipating structures 22 can be in thermal communication with the base 12, including the platform 31. As such, the heat dissipating structures 22 can be in thermal communication with the LEDs 18 via the circuit board 16. The structures 22 can be made from highly thermally conductive material, such as aluminum, another metal, or a highly thermally conductive plastic. The shape of the structures 22 can provide a high surface area to volume ratio, or otherwise be designed to aid heat dissipation. For example, the structures 22 can be pins as shown in FIG. 3, fins, concentric conical shapes of varying diameters, a lattice-type structure, or any other heat-sink type shape. The heat dissipating structures 22 can be integrally formed with the base 12 (e.g., via machining or casting), or formed separately and attached thereto.

The shrouds 24 and 25 can protect against accidental contact with the bulb 10. For example, the shrouds 24 and 25 can be formed of thermally insulating materials (e.g., plastic) and spaced from the base 12 and heat dissipating structures 22, respectively, so as to remain at a relatively cool temperature regardless of the temperatures of the base 12 and/or the heat dissipating structures 22. The shroud 24 can extend over a distal end of the cavity 32 and can be attached to the light pipe 20. For example, the shroud 24 can be attached to the inner radial surface 40 of the light pipe 20 adjacent the distal end of the light pipe 20 opposite the platform 31 so as not to block any light passing through the distal end of the light pipe 20. The shroud 24 can be adhered to the light pipe 20 or attached in another manner (e.g., the shroud 24 can be integrally formed with the light pipe 20). The shroud 24 can include apertures to facilitate airflow between the cavity 32 and the ambient environment, or the shroud can be solid 24. The shroud 24 can protect against inadvertent contact with the heat dissipating structures 22, which may become hot during usage of the bulb 10. Similarly, the shroud 25 can cover the base 12, and can also cover a junction between the light pipe 20 and base 12. The shroud 25 can protect against inadvertent contact with the base 12.

In operation, the bulb 10 can be installed in a conventional fixture, such as an Edison-type fixture in a lamp, ceiling or other location. Electricity can be supplied to the bulb 10 via the connector 26, and the electricity can pass to the electronics 14. The electronics 14 can convert the electricity to a form acceptable for the LEDs 18, and the converted electricity can pass to the circuit board 16 and, in turn, the LEDs 18. In response, the LEDs 18 can produce light. The light can enter the light pipe 20, which can distribute the light to replicate a conventional incandescent bulb or some other predetermined pattern. Heat produced by the LEDs 18 during operation can pass through the circuit board 16 to the base 12, and from the base 12 to the ambient environment and to the heat dissipating structures 22. The heat dissipating structures 22 can dissipate heat into the cavity 32. Heat in the cavity 32 can reach the ambient environment by dissipating across or through apertures in the shroud 24. As a result of the heat dissipation abilities of the base 12 and its heat dissipating structures 22, the LEDs 18 can produce a sufficient amount of light to replace an incandescent bulb or another type of light without overheating. Further, the light pipe 20 can distribute that light in a manner replicating the even distribution of the incandescent bulb, although other distributions are also possible.

In another example shown in FIG. 4, the LED-based bulb 10 can include a second circuit board 42 atop the heat dissipating structures 22 and having LEDs 18 mounted thereon. The second circuit board 42 and its LEDs 18 can supplement or act as a substitute for light passing out the distal end of the light pipe 20. The second circuit board 42 can be attached to the heat dissipating structures 22 using, as an example, thermally conductive tape or an adhesive, and the board 42 can be electrically connected to the electronics 14 or the circuit board 16 using electrically conductive wires that extend through the cavity 32. If the shroud 24 is used, the shroud 24 can be formed of a light transmitting material.

Another example of an inside-out LED-based bulb 100 shown in FIG. 5 includes organic LEDs (also known as OLEDs) 102. The bulb 100 can include a base 106 having an electrical connector 108 and housing electronics 110 in a cavity 113 similar to as described above in respect of the base 12, its connector 26 and electronics 14. The OLEDs 102 can be in electrical communication with the electronics 110 for receiving power received by the connector 108. The base 106 can have a conical flange 112, and the OLEDs 102 can be attached to an outer radial surface 112*a* the conical flange 112 such that the OLEDs 102 extend circumferentially about the flange 112. The OLEDs 102 can be attached to the flange 112 using, as example, adhesive or thermally conductive tape. The base 106 can additionally include heat dissipating structures 114, such as pins, fins, a lattice-type structure, a series of concentric conical extensions, or other high surface area to volume shapes, radially inward of the OLEDs 102 and the flange 112. The flange 112 and structures 114 can be in thermal communication such that the structures 114 can aid in dissipating heat transferred from the OLEDs 102 to the flange 112. A thermal shroud 116 can extend over the flange 112 to cover the flange and structures 114, and the shroud 116 can have the same configuration as the shroud 24 discussed above with respect to FIG. 1.

Note that the OLEDs 102 need not extend continuously about the entire surface of the exterior surface 112*a* of the flange 112, and can instead, as an example, be circumferentially or longitudinally spaced from one another. Alternatively, a single OLED 102 can be wrapped around the flange 112. Additionally, another OLED or LED can be attached to a distal end of the heat dissipating the flange 112 and/or structures 114 for producing light along the axis 104. Also, the flange 112 can be formed of multiple discrete, circumferentially spaced flange portions or can have an alternative structure for supporting OLEDs 102 and receiving heat therefrom.

In operation, as a result of being attached to the flange 112 the OLEDs 102 are in thermal communication with the flange 112 and heat produced by the OLEDs 102 during operation can be communicated to the base 106. The OLEDs 102 can produce light radially outward from the axis 104 in a distribution replicating an incandescent bulb. Further, since heat can be effectively dissipated from the OLEDs 102 by the flange 112 and heat dissipating structures 114, the OLEDs 102 can operate at a sufficiently high power to produce a similar amount of light as an incandescent bulb without overheating.

Figure 7:
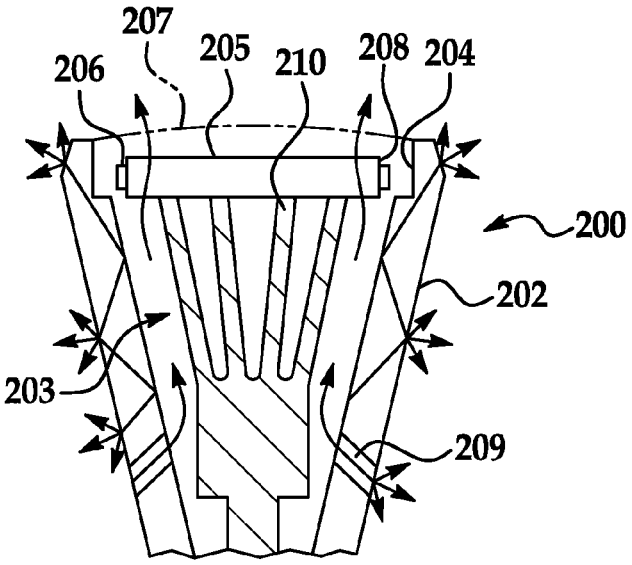
FIG. 7 is a cross sectional view of a portion of a further example of an inside-out LED-based bulb taken along a longitudinal axis of the LED-based bulb.

FIG. 7 shows another example of an inside-out of an inside-out LED-based bulb 200. The bulb 200 includes a conical light pipe 202 having a light receiving portion 204 along a radial interior of a distal end of the light pipe 202 (relative to a base not shown in FIG. 7). Alternatively, the light receiving portion 204 can have a different location, such as spaced more toward a proximal end of the light pipe 202. The light receiving portion 204 can extend circumferentially about the entire light pipe 202 or can be comprised of a series of light receiving portions. Heat dissipating structures 210, such as pins, fins, or at lattice structure, can extend from a base toward a distal end of the light pipe 202 within a cavity 203 defined by the light pipe 202. A disk 205 of thermally conductive material can be positioned atop the heat dissipating structures 210 for thermal communication therewith. LEDs 206 can be positioned on an outer radial side 208 of disk 205. For example, the LEDs 206 can be mounted on an annular circuit board attached to the disk 205 and in electrical communication with a connector of the bulb 200. The LEDs 206 can face the light receiving portion 204 such that light produced by the LEDs 206 enters the light pipe 202 and can be distributed to replicate the distribution of light provided by, for example, an incandescent bulb. Alternatively, if no disk 205 is included, the LEDs 206 can be attached to distal ends of the heat dissipating structures 210. A thermally protective shroud 207 can span the cavity 203 to protect against, for example, in advertent contact with the disk 205 and/or LEDs 206, and the shroud 207 can include apertures for allowing air flow between the cavity 203 and ambient environment external the bulb 200.

In operation, the LEDs 206 can receive power from a fixture via any electronics included in a base of the bulb 200 and any circuit board on which the LEDs 206 are mounted. The LEDs 206 can produce light in response to receiving power, and that light can enter the light pipe 202. The light pipe 202 can distribute the light longitudinally and radially to replicate, for example, a conventional incandescent bulb. Heat produced by the LEDs 206 during operation can be communicated to the disk 205, from the disk 205 to the heat dissipating structures 210, and from the heat dissipating structures 210 to air in the cavity 203. The air in the cavity 203 can circulate with air in the ambient environment via, as example, apertures in the shroud 207 and apertures 209 formed in the light pipe 202. Thus, the LEDs 206 can be cooled to a sufficient extent that the LEDs 206 in the aggregate can produce enough light to replicate, as an example, an incandescent bulb.

Figure 8:
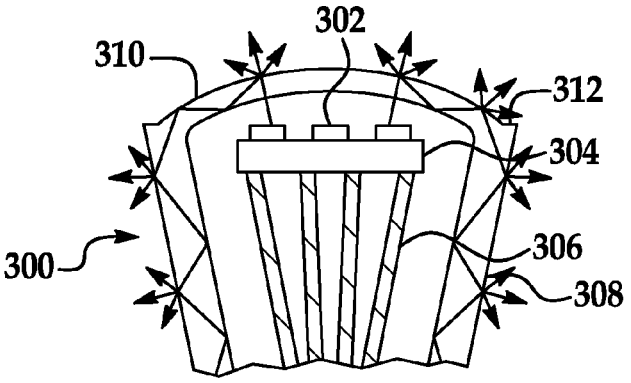
FIG. 8 is a cross sectional view of a portion of still a further example of an inside-out LED-based bulb taken along a longitudinal axis of the LED-based bulb.

Still another example of an inside-out LED-based bulb 300 is shown in FIG. 8. In this example, LEDs 302 are positioned on a circuit board 304 atop heat dissipating structures 306 similar to as explained with respect to FIG. 4. However, in this example, a light pipe 308 includes a domed-portion 310 spanning a distal end 312 of the light pipe 308. Additional LEDs can operationally be included to produce light that enters a proximal end of the light pipe as explained with respect to FIG. 1. The domed-portion 310 can act as a lens to distribute light produced by the LEDs 302 in a predetermined pattern, such as a pattern having the appearance of light produced by the distal end of a conventional incandescent bulb. Alternatively, the domed-portion 310 can act as light pipe allowing some light to exit a distal end of the bulb 300 and guiding some light toward a proximal end of the light pipe 308.

Figure 9:
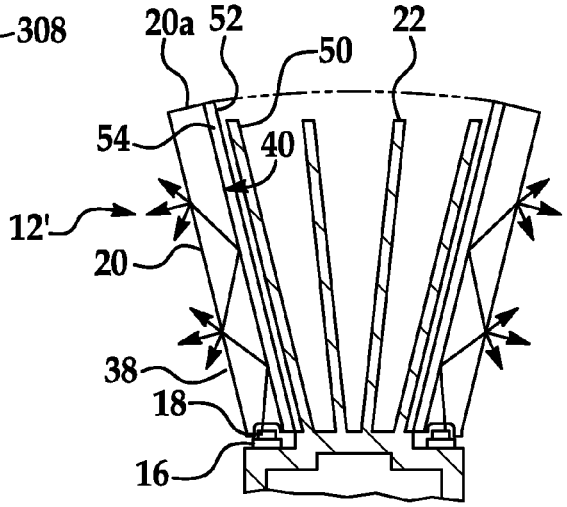
FIG. 9 is a cross sectional view of a portion of yet a further example of an inside-out LED-based bulb taken along a longitudinal axis of the LED-based bulb.

As shown in FIG. 9, another example of a base 12' is shown in conjunction with the circuit board 16, LEDs 18 and light pipe 20 from FIG. 1. In addition to including heat dissipating structures 22 spaced radially inward from the light pipe 20, the base 12' includes a flange 50 in thermal contact with the inner radial surface 40 of the light pipe 20. Thermal paste 52 can be applied at a junction between the inner radial surface 40 and the flange 50 to facilitate heat transfer from the light pipe 20 to the flange 50. Additionally, a reflector 54, such as reflective paint or a mirrored insert, can be applied to the inner radial surface 40 to ensure that all or nearly all light exits the outer radial surface 38 or the distal end 20*a* of the light pipe 20. Additionally, the light pipe 20 can be modified in other manners to obtain a predetermined light distribution. For example, a layer of diffusive material can be applied over the outer radial surface 38 and/or the distal end 20*a* of light pipe 20, or the light pipe 20 can include surface roughening or other light diffracting structures along one or both of the outer surface 38 and the distal end 20*a* of the light pipe 20. Moreover, the treatment of the light pipe 20 can vary over its longitudinal dimension. For example, light diffracting structures can become more dense nearer the distal end 20*a* of the light pipe 20.

Figure 10:
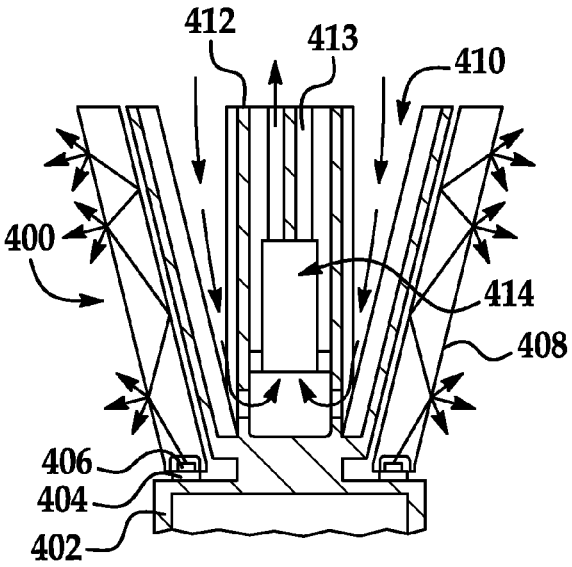
FIG. 10 is a cross sectional view of a portion of an additional example of an inside-out LED-based bulb taken along a longitudinal axis of the LED-based bulb.
Figure 11:
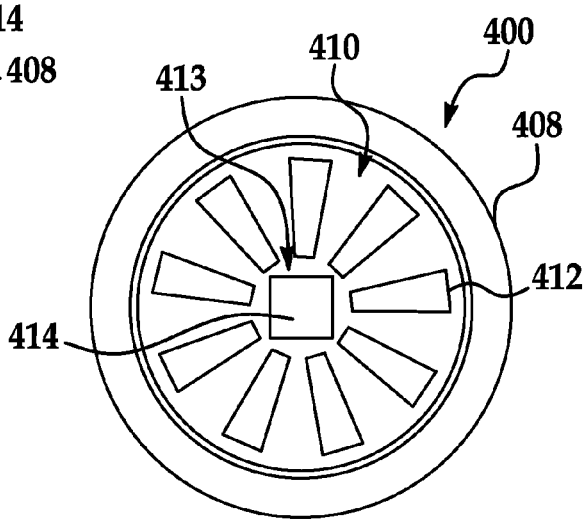
FIG. 11 is a top plan view of the bulb of FIG. 10.

In addition to facilitating heat transfer via the inclusion of the heat transferring structures, other example of an inside-out LED-based bulb can have active heat dissipating devices. For example, FIGS. 10 and 11 show an example of an LED-based bulb 400 including a base 402, an annular circuit board 404 having LEDs 406 mounted thereon, and an annular light pipe 408 that receives light produced by the LEDs 406 and defines a cavity 410 radially inward of the light pipe 408. Heat dissipating structures 412, such as pins, fins, or a lattice structure, can be disposed in the cavity 410. Additionally, a piezo-driven fan 414 can be disposed in the cavity 410. For example, the heat dissipating structures 412 can define an open channel 413, and the fan 414 can be disposed in the channel 413 and supported by adjacent heat dissipating structures 412. The fan 414 can be operable in response to its temperature becoming elevated to produce an airflow. Thus, the fan 414 can facilitate convective heat transfer from the heat dissipating structures 412 to an ambient environment about the bulb 400 without using any electricity. Alternatively, the piezo-driven fan 414 can be disposed at a different location, such as underlying the heat dissipating structures 412.

The above-described examples have been described in order to allow easy understanding of the invention and do not limit the invention. On the contrary, the invention is intended to cover various modifications and equivalent arrangements, whose scope is to be accorded the broadest interpretation so as to encompass all such modifications and equivalent structure as is permitted under the law.

The invention claimed is:

1. An LED based light for replacing an incandescent bulb, comprising:

a base having a first end and a second end;

a connector fixed to the first end of the base, the connector adapted to physically connect to an incandescent light fixture;

an open-ended light structure extending from the second end of the base, the light structure having an inner surface defining a cavity in fluid communication with an ambient environment and an opposing outer surface forming an exterior of the LED based light;

at least one LED carried by the second end of the base and positioned between the inner surface and the outer surface of the open-ended light structure; and a heat dissipating structure for the at least one LED extending into the cavity.

2. The LED based light of claim 1, wherein the heat dissipating structure includes a plurality of longitudinally extending pins.

3. The LED based light of claim 1, wherein the heat dissipating structure includes a plurality of longitudinally extending fins.

4. The LED based light of claim 1, further comprising:

an active heat dissipating device disposed for drawing air across the heat dissipating structure.

5. The LED based light of claim 1, further comprising:

a thermal insulating shroud disposed about the base.

6. The LED based light of claim 1, further comprising:

a thermal insulating shroud extending over the open end of the light structure to enclose the heat dissipating structure in the cavity.

7. The LED based light of claim 1, further comprising:

electronics housed in the base, the electronics configured to supply power to the at least one LED.

8. The LED based light of claim 7, wherein the base defines a plurality of apertures configured to allow airflow between the electronics and the ambient environment.

9. The LED based light of claim 1, wherein the at least one LED is arranged to emit light in a predetermined distribution that at least partially replicates that of an incandescent bulb.

10. The LED based light of claim 1, wherein the base and the heat dissipating structure are integrally formed.

11. The LED based light of claim 1, wherein the base, the light structure and the heat dissipating structure are integrally formed.

12. The LED based light of claim 1, wherein the light structure is an annular flange.

13. The LED base light of claim 1, wherein the outer surface is contoured to form a conical profile.

14. The LED base light of claim 1, wherein the outer surface is contoured to form a bulbous profile.

15. An LED based light, comprising:

a base;

a connector fixed to the base, the connector adapted to physically connect to an incandescent light fixture;

an open-ended annular flange extending from the base along a longitudinal axis of the light, the flange having an inner surface defining a cavity in fluid communication with an ambient environment and an opposing exterior outer surface;

at least one LED mounted on the base opposite the connector and positioned between the inner surface and the outer surface of the open-ended annular flange; and a heat dissipating structure for the at least one LED extending into the cavity.

16. The LED based light of claim 15, wherein the base, the flange and the heat dissipating structure are integrally formed.

17. The LED base light of claim 15, wherein the outer surface is contoured to form a conical profile.

18. The LED based light of claim 1, further comprising:

a circuit board positioned on a distal end of the heat dissipating structure; and at least one additional LED positioned on the circuit board.

19. The LED based light of claim 1, further comprising:

a disk located at a distal end of the heat dissipating structure, wherein the at least one LED is positioned on the disk.

* * * * *